US008319454B2

(12) United States Patent
Yin

(10) Patent No.: US 8,319,454 B2
(45) Date of Patent: Nov. 27, 2012

(54) DRIVING DEVICE, BACKLIGHT WITH THE DRIVING DEVICE AND DRIVING METHOD OF BACKLIGHT

(75) Inventor: Xinshe Yin, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 276 days.

(21) Appl. No.: 12/732,900

(22) Filed: Mar. 26, 2010

(65) Prior Publication Data

US 2010/0244739 A1 Sep. 30, 2010

(30) Foreign Application Priority Data

Mar. 27, 2009 (CN) ..... 2009 1 0081014

(51) Int. Cl.
*H05B 37/02* (2006.01)

(52) U.S. Cl. ..... 315/299; 315/291; 345/102

(58) Field of Classification Search ..... 315/291, 315/294, 299; 345/102
See application file for complete search history.

(56) References Cited

U.S. PATENT DOCUMENTS

| | | | | |
|---|---|---|---|---|
| 7,583,034 | B2 * | 9/2009 | Lara-Ascorra et al. | 315/291 |
| 7,825,610 | B2 * | 11/2010 | Zhao et al. | 315/299 |
| 7,880,404 | B2 * | 2/2011 | Deng et al. | 315/291 |
| 2007/0080911 | A1 | 4/2007 | Liu et al. | |
| 2007/0200513 | A1 | 8/2007 | Ha et al. | |
| 2008/0074364 | A1 | 3/2008 | Lara-Ascorra et al. | |
| 2008/0252222 | A1 | 10/2008 | Cusinato et al. | |
| 2008/0278432 | A1 | 11/2008 | Ohshima | |
| 2010/0013395 | A1 * | 1/2010 | Archibald et al. | 315/185 R |
| 2011/0074839 | A1 * | 3/2011 | Liu et al. | 345/690 |
| 2011/0204798 | A1 * | 8/2011 | Cusinato et al. | 315/161 |

FOREIGN PATENT DOCUMENTS

| | | | |
|---|---|---|---|
| CN | 1336092 | A | 2/2002 |
| CN | 1811886 | A | 8/2006 |
| CN | 101031171 | A | 9/2007 |
| CN | 101155451 | A | 4/2008 |
| CN | 101312001 | A | 11/2008 |

* cited by examiner

*Primary Examiner* — Thuy Vinh Tran
(74) *Attorney, Agent, or Firm* — Ladas & Parry LLP

(57) ABSTRACT

The present disclosure relates to a driving device for a backlight with a plurality of LED units. The driving device can include a control module for controlling output voltage of the driving device; a light modulation module for adjusting overall current of the backlight; and a current regulating module for obtaining signals for adjusting individual current of each LED unit and adjusting the individual current of each LED unit according to the signals.

9 Claims, 3 Drawing Sheets

DRIVING DEVICE, BACKLIGHT WITH THE DRIVING DEVICE AND DRIVING METHOD OF BACKLIGHT

BACKGROUND

The present invention relates to a driving device, a backlight with the driving device and a driving method of the backlight.

Thin film transistor liquid crystal display (TFT-LCD) is a one of popular flat display devices in the current market. TFT-LCD typically employs a backlight for providing a light source for the display. Most of backlights in the TFT-LCD use cold cathode fluorescent lamp (CCFL), which has advantages such as high brightness, low manufacturing cost, simple driving method and slim sizes, but also suffers from the potential environmental issue due to poisonous mercury material contained in the CCFL. Therefore, light emitting diode (LED) as an environment friendly device without mercury is more popular over CCFL also thanks to benefits such as low power consumption.

FIG. 1 is a schematic diagram showing a conventional driving device for LED backlight. As shown in FIG. 1, the driving device 1 is used for driving a LED backlight 2 with a plurality of LED units, or a plurality of strings of LED elements. The driving device 1 comprises a light modulation module 11 and a control module 12. The light modulation module 11 can control the overall current of the LED backlight according to external signals such as digital pulse width modulation (PWM) signal. The control module 12 can receive an external VIN signal and adjust output voltage of the driving device 1 accordingly to stabilize the output voltage. In the conventional driving device, the light modulation module 11 and the control module 12 can only control the overall current or voltage for the backlight. This might affect uniformity of brightness of the LED backlight if there is a discrepancy among the a plurality of strings of LED elements.

SUMMARY

The embodiment of the present invention provides a driving device which can control each LED unit of a LED backlight, thus improving uniformity of brightness of the LED backlight and display quality of LCD with the LED backlight. The embodiments of the present invention also provide a backlight with the driving device and a driving method of the backlight.

According to one embodiment of the present invention, there disclosed a driving device for a backlight with a plurality of LED units, comprising: a control module for controlling output voltage of the driving device; a light modulation module for adjusting overall current of the a plurality of LED units; and a current regulating module for obtaining signals for adjusting individual current of each LED unit and adjusting the individual current of each LED unit according to the signals.

In one example, the current regulating module can comprise a receiving unit for receiving signals for adjusting individual current of each LED unit in the backlight and a plurality of storing units for storing those signals.

In another example, the signal can be a digital signal and the current regulating module further can comprise a digital/analogous conversion unit for converting the digital signal into an analogous signal sent to each LED unit so as to adjust resistance of each LED unit.

In yet another example, the current regulating module can comprise a current sampling unit and a voltage regulating unit. The current sampling unit can be used for sampling individual current of each LED unit in the backlight so as to generate signals for adjusting voltage of each LED unit. The voltage regulating unit can be used for adjusting voltage of each LED unit according to the signals for adjusting voltage of each LED unit.

In yet another example, the voltage regulating unit can comprise a plurality of voltage regulators, each voltage regulator is dedicated to a respective LED unit and used for adjusting voltage of the respective LED unit according to the signal for adjusting the respective LED unit.

Alternatively, the current regulating module can comprise a plurality of voltage regulators. Each voltage regulator comprises a sampling resistor.

In yet another example, each LED unit is a color LED unit selected from a red LED, a green LED and a blue LED.

According to another embodiment of the present invention, there disclosed a backlight comprising: a plurality of LED units and a driving device. The driving device can comprise a control module for controlling output voltage of the driving device; a light modulation module for adjusting overall current of the a plurality of LED units; and a current regulating module for obtaining signals for adjusting individual current of each LED unit and adjusting the individual current of each LED unit according to the signals.

According to yet another embodiment of the present invention, there disclosed a driving method of a LED backlight with a plurality of LED units. The method can comprise following steps of: Step 101, obtaining signals for adjusting individual current of each LED unit in a backlight with a plurality of LED units; and Step 102, adjusting respective current of each LED unit in the backlight according to the signal.

In one example, the step of obtaining signals for adjusting individual current of each LED unit in a backlight with a plurality of LED units can comprise receiving digital signals for adjusting each LED unit. The step of adjusting respective current of each LED unit in the backlight according to the signal can comprise converting the digital signals into analogous signals sent to each LED unit for adjusting respective resistance of each LED unit.

In yet another example, the step of obtaining signals for adjusting individual current of each LED unit in a backlight with a plurality of LED units can comprise: obtaining current differences among LED units in the backlight; generating voltage adjusting signals for each LED unit according to the current difference. The step of adjusting respective current of each LED unit in the backlight according to the signal can comprise adjusting voltage of each LED unit according to the voltage adjusting signals, respectively.

According to the embodiments of the present invention, each LED unit in a LED backlight can be controlled separately by the current regulating module, thus improving uniformity of brightness of the LED backlight and display quality of LCD with the LED backlight.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION OF THE PREFERRED EMBODIMENTS

The embodiments of the present invention will be discussed in more detail with reference to the accompanying drawings.

According to the embodiments of the present invention, each LED unit of the backlight with a plurality of LED units can be controlled individually so as to obtain uniform current flowing through each LED unit.

Figure 1:
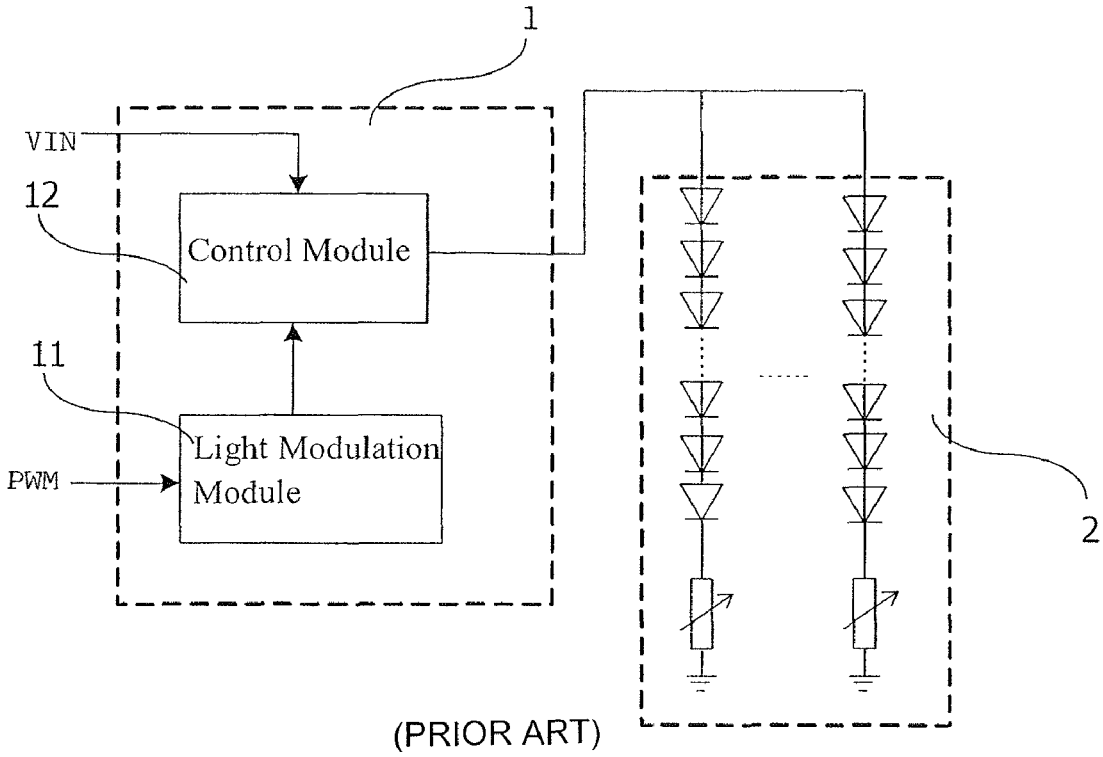
(PRIOR ART) Fig. 1
FIG. 1 is a schematic diagram showing a conventional driving device for LED backlight.
Figure 2:
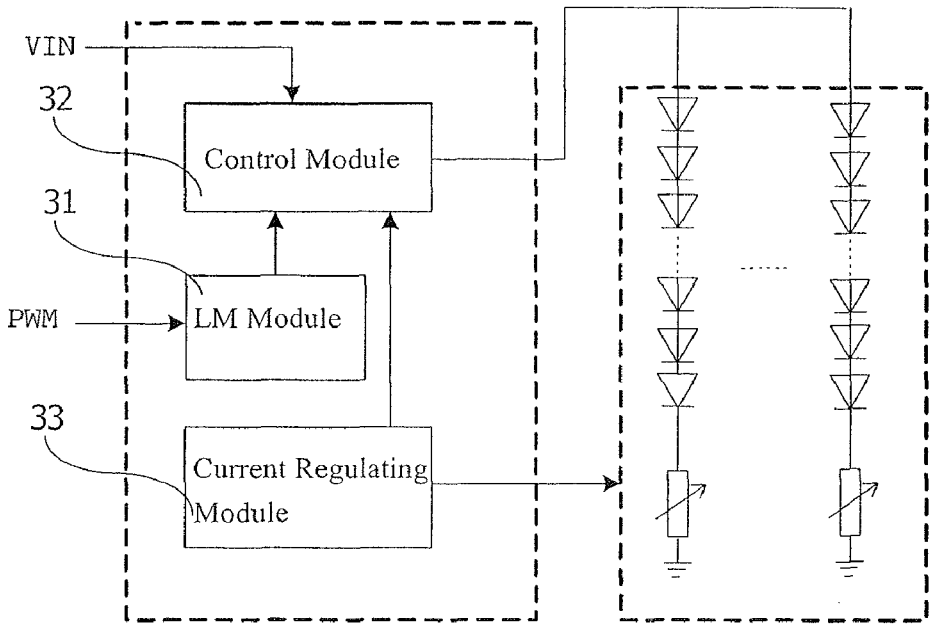
FIG. 2 is a schematic diagram showing a driving device for a LED backlight according to a first embodiment of the present invention.

FIG. 2 is a schematic diagram showing a driving device for a LED backlight with a plurality of LED units according to a first embodiment of the present invention. As shown in FIG. 2, the driving device can comprise a light modulation (LM) module 31, a control module 32 and a current regulating module 33. The light modulation module 31 can control the overall current of the LED backlight according to external signals such as digital pulse width modulation (PWM) signal. The control module 32 can receive an external VIN signal and adjust output voltage of the driving device 1 accordingly to stabilize the output voltage. The current regulating module 33 is used for adjusting the individual LED unit of the backlight, thus improving uniformity of brightness of the LED backlight and display quality of LCD with the LED backlight. Each LED unit corresponds to the serial LEDs that are arranged in each column as shown in FIG. 2.

Figure 3:
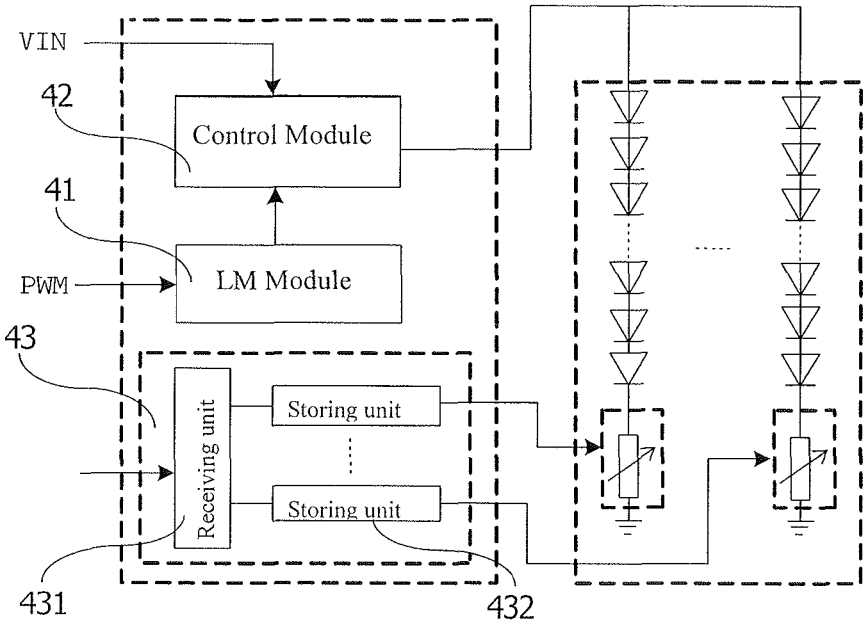
FIG. 3 is a schematic diagram showing a driving device for a LED backlight according to a second embodiment of the present invention.

FIG. 3 is a schematic diagram showing a driving device for a LED backlight according to a second embodiment of the present invention. As shown in FIG. 3, the driving device comprises a light modulation (LM) module 41, a control module 42 and a current regulating module 43. The light modulation module 41 and control module 42 are similar to the light modulation module 31 and control module 32 in the first embodiment, therefore the detailed description thereof is omitted. The current regulating module 43 comprises a receiving unit 431 for receiving signals for adjusting individual current of each LED unit in the backlight and a plurality of storing units 432 for storing those signals. Each storing unit 432 is dedicated to a respective LED unit and stores the signal for adjusting the respective LED unit. The signal can be digital signal. In this case, the driving device further comprises a digital/analogous conversion unit for converting a digital signal into an analogous signal so as to adjust resistance of each LED unit, and in turn adjust the current flowing through each LED unit.

The driving device according to the present embodiment adjusts the individual current of each LED unit according to the digital signals carrying adjustment information, so that brightness uniformity among a plurality of LED units in the backlight can be improved. Furthermore, for a backlight with RGB LED units, color coordinates and color gamut of the backlight can also be adjusted by tuning individual current for each RLED unit, GLED unit and BLED unit, respectively.

Figure 4:
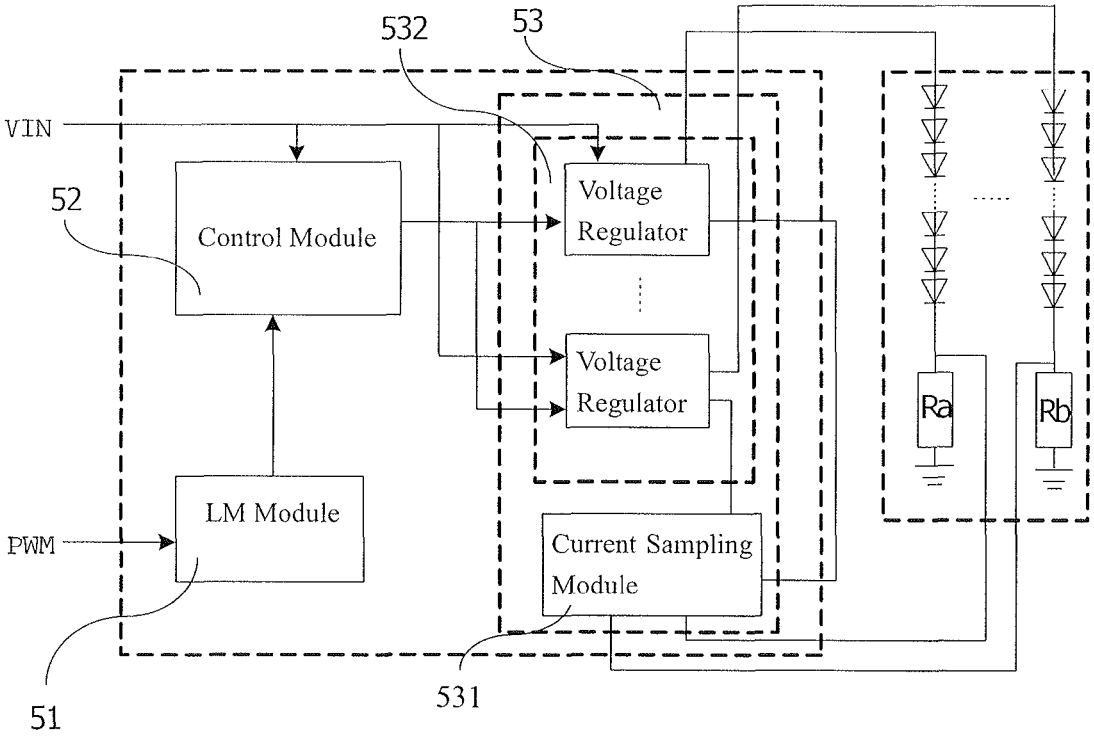
FIG. 4 is a schematic diagram showing a driving device for a LED backlight according to a third embodiment of the present invention.

FIG. 4 is a schematic diagram showing a driving device for a LED backlight according to a third embodiment of the present invention. As shown in FIG. 4, the driving device comprises a light modulation (LM) module 51, a control module 52 and a current regulating module 53. The light modulation module 51 and control module 52 are similar to the light modulation module 31 and control module 32 in the first embodiment, therefore the detailed description thereof is omitted. The current regulating module 53 comprises a current sampling unit 531 and a voltage regulating unit 532. The current sampling unit 531 is used for sampling individual current of each LED unit in the backlight so as to obtain information about current difference among LED units, which can be used to generate signals for adjusting voltage of each LED unit. The sampling can be done by sampling voltages on sampling resistor Ra, Rb in a measurement circuit, either by converting current signals into voltage signals or directly by voltage signals. The voltage regulating unit 532 is used for adjusting voltage of each LED unit according to the above-mentioned signals for adjusting voltage of each LED unit. The voltage regulating unit 532 can comprise a plurality of voltage regulators. Each voltage regulator is dedicated to a respective LED unit and used for adjusting the voltage of the respective LED unit according to the signal for adjusting the respective LED unit. The driving device according to the present embodiment adjusts the individual voltage of each LED unit, so that brightness uniformity among a plurality of LED units in the backlight can be improved. Furthermore, for a backlight with RGB LED units, color coordinates and color gamut of the backlight can also be adjusted by tuning individual voltage for each RLED unit, GLED unit and BLED unit, respectively.

Figure 5:
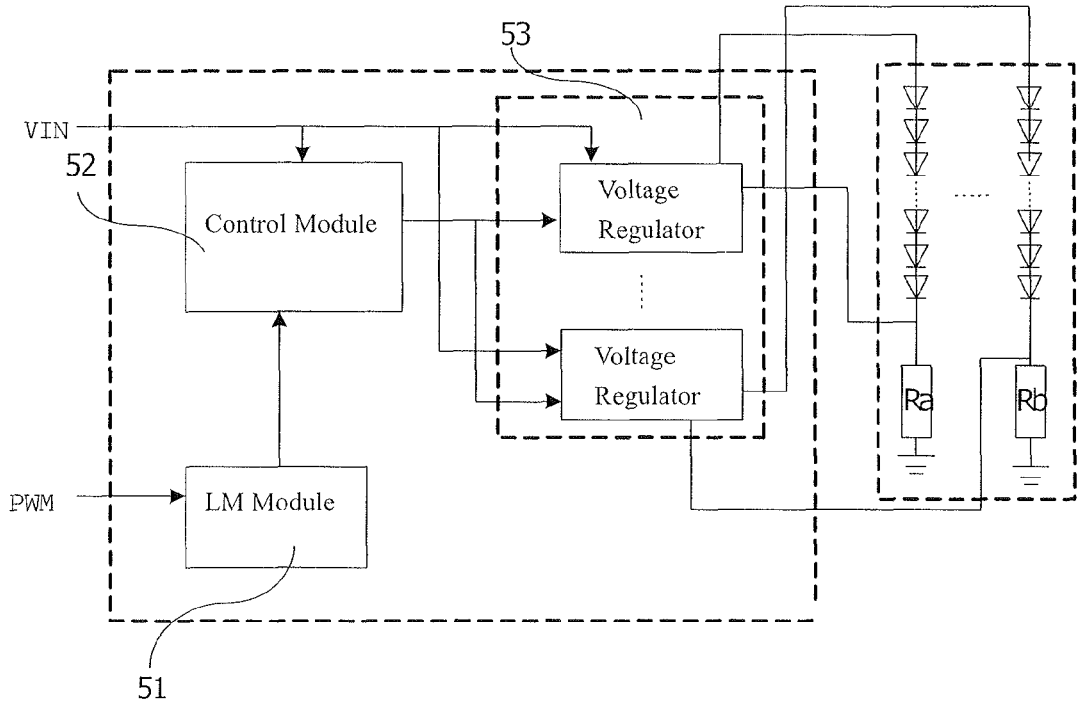
FIG. 5 is a schematic diagram showing a driving device according to a variation of the third embodiments shown in FIG. 4.

FIG. 5 is a schematic diagram showing a driving device according to a variation of the third embodiments shown in FIG. 4. The variant is substantially the same as the third embodiment, except that the current sampling unit is omitted, and each voltage regulator comprises a sampling resistor. The sampling resistor in each voltage regulator is used for obtaining respective current of each LED unit. The voltage regulator can adjust voltage of each LED unit according the respective current information.

In the above embodiments, the control module can also have other functions such as soft startup, over-current and over-voltage protection and provide a stable, secure and reliable voltage source. The light modulation module can adjust duty ratio of digital voltage of LED units in the backlight according to the digital PWM signal, so as to control the overall brightness of the LED backlight.

Figure 6:
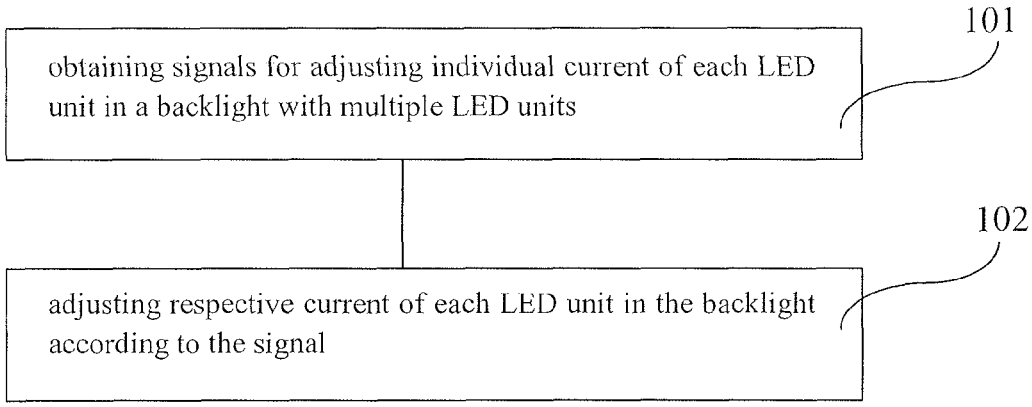
FIG. 6 is a flow chart illustrating a driving method of a LED backlight according to the present invention.

FIG. 6 is a flow chart illustrating a driving method of a LED backlight according to the present invention. As shown in FIG. 6, the method comprises following steps of:

Step 101, obtaining signals for adjusting individual current of each LED unit in a backlight with a plurality of LED units; and Step 102, adjusting respective current of each LED unit in the backlight according to the signal.

According to the driving method of the present embodiment, uniformity of brightness of the LED backlight and display quality of LCD with the LED backlight can be improved.

Furthermore, in the driving method according to the present embodiment, the step of obtaining signals for adjusting individual current of each LED unit in a backlight with a plurality of LED units can comprise receiving digital signals for adjusting each LED unit. The step of adjusting respective current of each LED unit in the backlight according to the signal can comprise converting the digital signals into analogous signals sent to each LED unit for adjusting respective resistance of each LED unit.

In addition, the step of obtaining signals for adjusting individual current of each LED unit in a backlight with a plurality of LED units can comprise: obtaining current differences among LED units in the backlight; generating voltage adjusting signals for each LED unit according to the current difference. The step of adjusting respective current of each LED unit in the backlight according to the signal can comprise adjusting voltage of each LED unit according to the voltage adjusting signals, respectively. The current differences among LED units in the backlight can be obtained by sampling individual current of each LED. For example, signals of brightness or color of each LED unit can be obtained in order to calculate their differences, which in turn can be used to determine current difference among LED units. The current difference can be used to generate voltage adjusting signals. And eventually, the voltage of each LED unit can be adjusted according to voltage adjusting signals, respectively. Alternately, the current of each LED unit can be adjusted respectively.

According to the embodiments of the present invention, each LED unit of the backlight with a plurality of LED units can be controlled individually so as to obtain uniform current flowing through each LED unit, thus improving uniformity of brightness of the LED backlight and display quality of LCD with the LED backlight. Furthermore, for a backlight with RGB LED units, color parameters such as color coordinates and color gamut of the backlight can also be adjusted by tuning individual voltage for each RLED unit, GLED unit and BLED unit, respectively.

The invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

What is claimed is:

1. A driving device for a backlight with a plurality of LED units, comprising:

a control module for controlling output voltage of the driving device;

a light modulation module for adjusting overall current of the plurality of LED units; and a current regulating module for obtaining signals for adjusting individual current of each LED unit according to the signals;

wherein the current regulating module comprises a receiving unit for receiving signals for adjusting the individual current of each LED unit in the backlight and a plurality of storing units for storing those signals.

2. The driving device according to claim 1, wherein each of the signals is a digital signal and the current regulating module further comprises a digital/analogous conversion unit for converting the digital signal into an analogous signal sent to each LED unit so as to adjust resistance of each LED unit.

3. The driving device according to claim 1, wherein the current regulating module comprises a plurality of voltage regulators, each voltage regulator comprises a sampling resistor.

4. The driving device according to claim 1, wherein each LED unit is a color LED unit selected from a red LED, a green LED and a blue LED.

5. A backlight, comprising:

a plurality of LED units; and a driving device, comprising:

a control module for controlling output voltage of the driving device;

a light modulation module for adjusting overall current of the plurality of LED units; and a current regulating module for obtaining signals for adjusting individual current of each LED unit according to the signals;

wherein the current regulating module comprises a receiving unit for receiving signals for adjusting the individual current of each LED unit in the backlight and a plurality of storing units for storing those signals.

6. The backlight according to claim 5, wherein each of the signals is a digital signal and the current regulating module further comprises a digital/analogous conversion unit for converting the digital signal into an analogous signal sent to each LED unit so as to adjust resistance of each LED unit.

7. The backlight according to claim 5, wherein the current regulating module comprises a plurality of voltage regulators, each voltage regulator comprises a sampling resistor.

8. The backlight according to claim 5, wherein each LED unit is a color LED unit selected from a red LED, a green LED and a blue LED.

9. A method of driving a LED backlight with a plurality of LED units, the method comprising following steps of:

obtaining signals for adjusting individual current of each LED unit of the plurality of LED units in the backlight; and adjusting respective current of each LED unit in the backlight according to the obtained signal;

wherein the step of obtaining signals for adjusting the individual current of each LED unit in the backlight comprises:

obtaining current differences among LED units in the backlight;

generating voltage adjusting signals for each LED unit according to the current difference; and the step of adjusting respective current of each LED unit in the backlight according to the obtained signal comprises adjusting voltage of each LED unit according to the voltage adjusting signals, respectively.

* * * * *